US005810218A

United States Patent [19]

Falcaro

[11] Patent Number: 5,810,218

[45] Date of Patent: Sep. 22, 1998

[54] BOTTLE CARRIER

[76] Inventor: Steven M. Falcaro, 1741 Braman Ave., Fort Myers, Fla. 33901

[21] Appl. No.: 925,158

[22] Filed: Sep. 8, 1997

Related U.S. Application Data

[60] Provisional application No. 60/025,494 Sep. 12, 1996.

[51] Int. Cl.[6] ..... A45F 5/00

[52] U.S. Cl. ..... 224/148.4; 224/148.1; 224/148.5

[58] Field of Search ..... 224/148.4, 148.1, 224/148.5, 148.7, 148.2, 148.3, 603, 257, 148.6; D3/229

[56] References Cited

U.S. PATENT DOCUMENTS

| | | | |
|---|---|---|---|
| D. 333,071 | 2/1993 | Lim | D3/229 |
| D. 335,392 | 5/1993 | Topic et al. | D3/229 |
| D. 347,734 | 6/1994 | Patterson et al. | D3/229 |
| 5,167,354 | 12/1992 | Cohanfard | 224/148.4 |
| 5,203,481 | 4/1993 | Dobbins et al. | 224/148.1 |
| 5,577,647 | 11/1996 | Pittarelli et al. | 224/148.1 |

*Primary Examiner*—David J. Walczak
*Attorney, Agent, or Firm*—Frank A. Lukasik

[57] ABSTRACT

A device for carrying a bottle of liquid over a shoulder consisting of a flat base with a first portion oval shaped and a second portion formed with a "U" shaped hole having a larger opening beginning at the outer edge and diminishing in size towards the middle of the base. The two ends each have a hole formed therein and a cord is strung through each of the end holes and joined with a clamp to form a continuous loop.

2 Claims, 2 Drawing Sheets

BOTTLE CARRIER

RELATED INVENTION

This application is a Continuation-In-Part of Provisional Application Ser. No. 60/025,494, Filed Sept. 12, 1996.

BACKGROUND OF THE INVENTION

1. Field of the Invention

This invention relates generally to a bottle carrier and more particularly to a device for carrying a large soda bottle over the shoulder.

2. Background of the Invention

Bottled water has become a commodity which has become very popular for outdoor events and other events which last for long periods and where drinking water is not readily available or is of questionable quality. In addition, tennis players and other athletes, often fill an empty soda battle, freeze it, and then carry the bottle to the sporting event. Golf fans following their favorite pros along the golf course can often be seen carrying a bottle of mineral water as they walk along the fairways. Each of the above uses require holding the bottle in their hands. In the case of the bottle of ice water, it is uncomfortable to carry and begins to thaw because of the body heat of the user. The frozen bottle may also be carried in a tennis bag, however, the condensation collecting on the outside of the bottle will wet anything being carried in the tennis bag.

In addition to carrying bottles of water, sports fans may wish to carry full bottles of soda. In the case of a bottle of soda, it is more important not to hold the bottle in the hands because of the effect of body temperature on the carbonation of the soda and the resulting foam and loss of pressure in the bottle. What is needed is some type of holder, or handle to conveniently carry the bottle without spilling or warming the contents.

SUMMARY OF THE INVENTION

The invention is a simple device which allows a person to carry a small or large soda bottle over the shoulder, thus freeing the hands for other activities. The bottle carrier is a piece of plastic with an elongated "U" shaped hole cut into one edge, so a plastic soda bottle's neck can fit into the hole. This plastic piece has a cord that is threaded through a hole in each end of the elongated "U" shaped hole and tied in a complete loop. The elongated "U" shaped hole is placed against the top neck of the bottle, the cord is placed on the side opposite the hole, and the cord is drawn taut to hold the bottle head in place. The cord is then used to as a shoulder strap to carry the bottle.

DESCRIPTION OF THE PREFERRED EMBODIMENT

Figure 1:
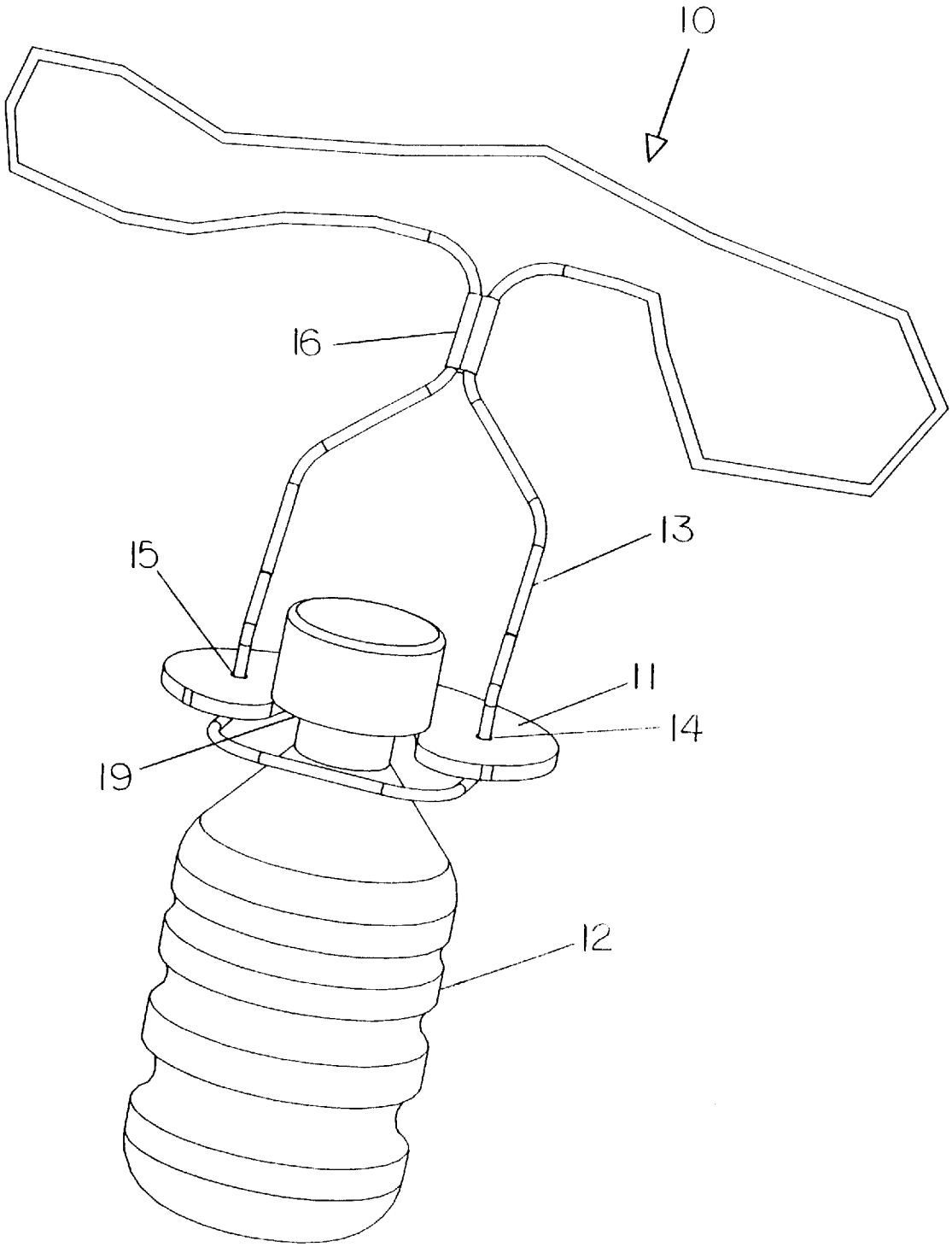
FIG. 1 is a top, front, perspective view of a bottle carrier in accordance with the invention.

Referring to FIG. 1, there is shown the bottle holder of the invention denoted generally by the numeral 10. The bottle holder 10 is shown in perspective in FIG. 1. The base 11 is constructed from a flat plastic plate and is of a relatively oval shape. The base 11 is sufficiently thick to provide a stable base for carrying the bottle 12 in combination with the cord 13. The cord 13 is strung through holes 14 and 15 and then joined at a point with clamp 16. Clamp 16 may be made of metal such as stainless steel, brass or aluminum or any suitable state of the art material.

Figure 2:
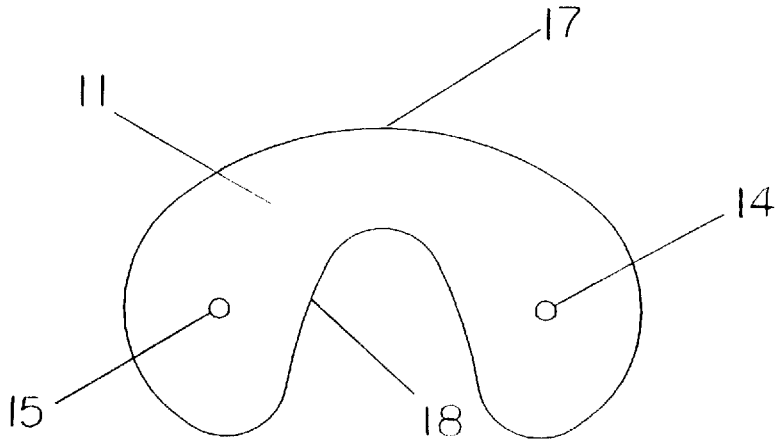
FIG. 2 is a top perspective view of the plastic bottle holder of the invention.

As shown in FIG. 2, a first portion of the outer edge of the base 11 is formed in an oval shape 17. A second portion of the outer edge of the base 11 is formed with a "U" shaped hole 18 having a larger opening beginning at the outer edge and diminishing in size towards the middle of the base 11. Hole 18 is shaped to fit the largest bottles 12 currently on the market (2 liters-67.6 FL. OZ) (2 quarts 3.6 OZ) to a small size bottle of wine (187 ml.). Base 11 is fit under the bottle top 19 where it is drawn into gripping contact by cord 13 as it is gradually drawn through the holes 14 and 15.

In a preferred embodiment, the base 11 was three inches wide, one and three quarter inches deep, and one eighth inch thick. The holes 14 and 15 were one eighth inch in diameter. The cord 13 was three sixteenths of an inch wide and the closed loop of cord 13 was twenty four inches long. The hole 18 was one and one half inches wide at the outer edge and reduced to about one inch in diameter at the bottom of the hole 18.

In operation, the user would generally fill a two liter plastic bottle of water, place the bottle in the freezer, and then withdraw the bottle of frozen water when ready for use. The user would then pull the cord 13 to open the hole 18. The bottle top 19 is then placed between the cord 13 and the base 11 and the cord 13 is pulled upwardly to close the opening of hole 18. The bottle 12 is then ready to carry to the event.

While the invention has been explained with respect to a preferred embodiment thereof, it is contemplated that various changes may be made in the invention without departing from the spirit and scope thereof.

What is claimed is:

1. A device for carrying a bottle of liquid over a shoulder comprising:

a flat base having a first end, a second end, and an outer edge, said outer edge having an oval shaped portion and a bottle engaging second portion formed with a "U" shaped hole having a larger opening beginning at said outer edge and diminishing in size towards the middle of said base, said "U" shaped hole being sized to fit under the top of a bottle in a range of a large size, two liter bottle, 67.6 fluid ounces, down to a small size bottle, 187 ml., each of said first and second ends having a hole formed therein, and a cord strung through each of said holes and joined at a point with a clamp thereby forming a continuous loop, said loop being adapted to fit under the top of the bottle and to cooperate with said base to grip the bottle when said cord is drawn.

2. The device for carrying a bottle of liquid over a shoulder as described in claim 1, wherein said base is three inches wide, one and three quarter inches deep, one eighth inch thick and said U shaped hole is one and one half inches wide at said outer edge and reduced to about one inch in diameter at the bottom of said hole.

* * * * *